US009820068B2

(12) United States Patent
Zhang

(10) Patent No.: US 9,820,068 B2
(45) **Date of Patent: *Nov. 14, 2017**

(54) MICRO SPEAKER WITH CAPACITORS FORMED BY CONDUCTIVE COVER AND SEGMENTED DIAPHRAGM

(71) Applicant: AAC Technologies Pte. Ltd., Singapore (SG)

(72) Inventor: Yang Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 27 days.

This patent is subject to a terminal disclaimer.

(21) Appl. No.: 15/011,454

(22) Filed: Jan. 29, 2016

(65) Prior Publication Data

US 2017/0013381 A1 Jan. 12, 2017

(30) Foreign Application Priority Data

Jul. 9, 2015 (CN) ..... 2015 2 0517890 U

(51) Int. Cl.

| | |
|---|---|
| ***H04R 1/00*** | (2006.01) |
| ***H04R 29/00*** | (2006.01) |
| ***H04R 7/12*** | (2006.01) |
| *H04R 9/06* | (2006.01) |
| *H04R 7/18* | (2006.01) |
| *H04R 1/06* | (2006.01) |

(52) U.S. Cl.

CPC ..... *H04R 29/003* (2013.01); *H04R 7/127* (2013.01); *H04R 1/06* (2013.01); *H04R 7/18* (2013.01); *H04R 9/06* (2013.01); *H04R 2307/204* (2013.01)

(58) Field of Classification Search

CPC ... H04R 7/00; H04R 7/02; H04R 7/04; H04R 7/06; H04R 7/122; H04R 7/127; H04R 9/02; H04R 9/025; H04R 9/06; H04R 2209/024

USPC ..... 381/152, 162, 191, 396, 398, 399, 400, 381/412, 417, 418, 419, 420, 421, 422, 381/423, 424, 426, 427, 429, 430, 431

See application file for complete search history.

(56) References Cited

U.S. PATENT DOCUMENTS

| | | | | |
|---|---|---|---|---|
| 2002/0067663 | A1* | 6/2002 | Loeppert | B81B 3/0072 367/181 |
| 2006/0188126 | A1* | 8/2006 | Andersen | H04M 1/03 381/396 |
| 2016/0094917 | A1* | 3/2016 | Wilk | H04R 19/02 381/398 |

* cited by examiner

*Primary Examiner* — Katherine Faley
(74) *Attorney, Agent, or Firm* — Na Xu; IPro, PLLC

(57) ABSTRACT

A micro speaker is disclosed. The micro speaker includes a diaphragm and a voice coil for driving the diaphragm, the diaphragm including a conductive dome and a suspension surrounding the conductive dome, the conductive dome including a plurality of units being isolated from each other; a conductive front cover located adjacent to and keeping a distance from the conductive dome; and a plurality of capacitors formed by the units of conductive dome and the conductive front cover for outputting electrical signals according to vibrations of the diaphragm and for detecting real-time replacement of the diaphragm.

4 Claims, 1 Drawing Sheet

MICRO SPEAKER WITH CAPACITORS FORMED BY CONDUCTIVE COVER AND SEGMENTED DIAPHRAGM

FIELD OF THE INVENTION

The present invention relates to the field of electroacoustic transducers, more particularly to a micro speaker.

DESCRIPTION OF RELATED ART

The normal or typical method to detect the amplitude of the diaphragm of a speaker is linear estimation method. This type of method cannot detect the real-time amplitude of the diaphragm correctly.

The present invention provides an improved method or solution to detect the real-time amplitude of the diaphragm of a micro speaker.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the Figs. and the embodiment. It should be understood the specific embodiment described hereby is only to explain this disclosure, not intended to limit this disclosure.

Figure 1:
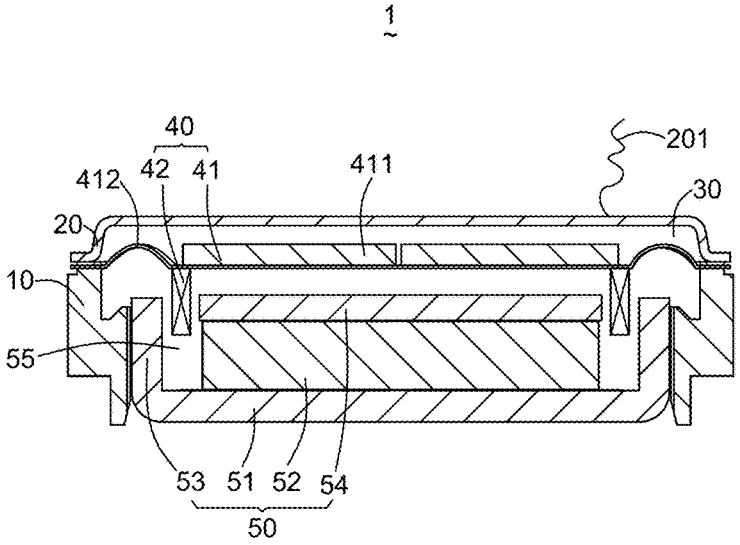
FIG. 1 is a cross-sectional view of a micro speaker in accordance with an exemplary embodiment of the present disclosure.

Referring to FIG. 1, a micro speaker 1 in accordance with a first embodiment of the present disclosure comprises a frame 10, a conductive front cover 20 engaging with the frame 10, a receiving space 30 formed by the frame 10 and the conductive front cover 20, a vibration system 40 and a magnetic circuit system 50 respectively received in the receiving space 30.

The vibration system 40 includes a diaphragm 41 and a voice coil 42 driving the diaphragm 41 to generate sounds. The diaphragm 41 includes a conductive dome 411 and a suspension 412 surrounding the conductive dome 411. The conductive dome 411 includes a plurality of units being isolated from each other.

The magnetic circuit system 50 includes a lower plate 51, a first magnetic part 51 mounted on the lower plate 50, and a second magnetic part 53 located on the lower plate 50. At least one of the first and second magnetic parts 52, 53 is a permanent magnet. When one of the first and second magnetic parts 52, 53 is a permanent magnet, the other is a permanent magnet, or is a magnetic conduction component. The second magnetic part 53 surrounds and keeps a distance from the first magnetic part 52 thereby forming a magnetic gap 55 therebetween. The voice coil 42 is partially received in the magnetic gap 55. The magnetic circuit system 50 further includes a pole plate 54 attached to the first magnetic part 52. The lower plate 51 is not restricted to the structure shown in FIG. 1. In the present disclosure, any component having a part for supporting or carrying the first magnetic part 52 or the second magnetic part 53 should be construed as the lower plate. When the first magnetic part 52 is a permanent magnet, the second magnetic part 53 could be sidewalls extending from the lower plate 51, and the magnetic gap 55 is formed between the sidewalls and the first magnetic part. When the second magnetic part 53 is a permanent magnet, the first magnetic part 52 could be a pillar extending from the lower plate 51 and surrounded by the second magnetic part 53. When both of the first and second magnetic parts are permanent magnets, the lower plate 51 could be a planar plate for carrying the magnets.

A plurality of capacitors is formed between the units of the conductive dome 411 and the conductive front cover 20. In this embodiment, the conductive dome 411 could be an aluminum foil dome or a compound aluminum foil dome. In fact, the conductive dome 411 could be a metallic dome, a multi-layer dome having a metallic layer, or a compound dome having conductivity. The conductive front cover 20 could be a metallic cover located above or below the conductive dome 411, or be a non-conductive member with a conductive layer combined therewith, or a non-conductive member with a conductive layer formed by LDS, or be a non-conductive member with a flexible printed circuit attached thereto. In fact, any configuration of the conductive front cover is feasible, as long as the front cover forms a capacitor with the conductive dome.

When the diaphragm 41 vibrates, the conductive dome 411 will move synchronously. Accordingly, distances between the conductive front cover 20 and the units of the conductive dome 411 are changed. The values of the capacitors formed by the units of the conductive dome 411 and the conductive front cover 20 are thereby changed. Electrical signals outputted by the capacitor reflect the real-time amplitude of the diaphragm 41. In this embodiment, the amount of the units of the conductive dome 411 is four, and four capacitors are accordingly formed. The four units are respectively electrically connected to four conductive pads 412*d* located at 4 arc sides 412*c*. By virtue of the configuration of the units, unbalanced vibration of the diaphragm could be also detected.

Figure 2:
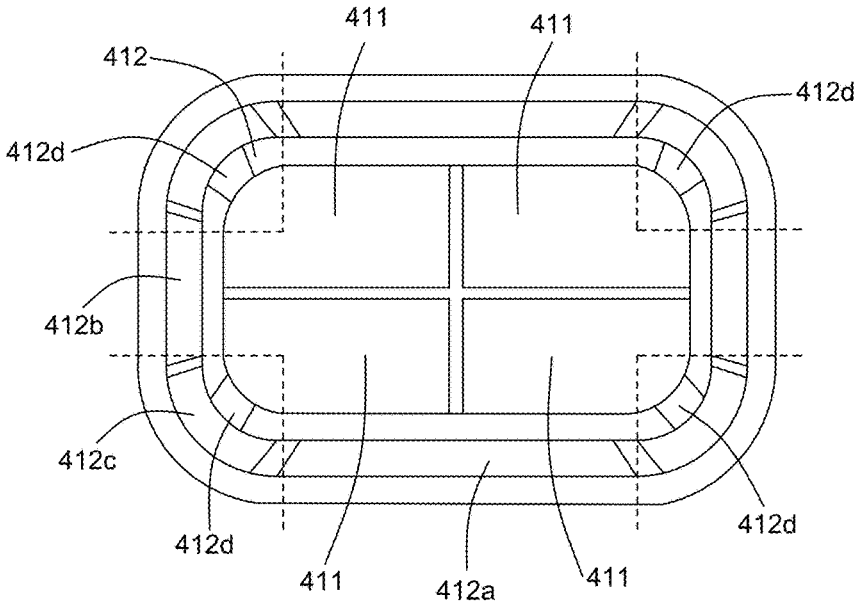
FIG. 2 is an illustration view of a diaphragm of the speaker in FIG. 1.

Referring to FIG. 2, the suspension 412 is made of silica, and includes a first part and a second part. The first part is made of non-conductive silica and the second part is made of conductive silica. The suspension 412 includes a pair of long sides 412*a*, a pair of short sides 412*b*, and arc sides 412*c* connecting the long sides and the short sides. In this embodiment, the second part is formed at the arc sides. Further, the suspension 412 includes conductive pads 412*d* located at the arc sides 412*c*. The units of the conductive dome 411 electrically connect to the conductive pads 412*d*, and electrical signals from the units of the conductive dome 411 are outputted via the arcs 412*c*. Of course, the second part could also be formed at the long sides 412*a*, and the conductive pads 412*d* could be located at the long sides. Electrical signals produced by the capacitor are outputted via the long sides 412*a*. The second part could also be formed at the short sides 412*b*, and the conductive pads 412*d* could be located at the short sides. Electrical signals produced by the capacitor are outputted via the short sides 412*b*.

The conductive front cover 20 includes a lead wire 201 for outputting electrical signals from the conductive front cover 20. The lead wire 201 could be a conductive wire or patterns formed on a substrate.

By virtue of the configuration described above, the real-time amplitude of the diaphragm could be correctly detected.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro speaker, comprising:

a frame, a conductive front cover engaging with the frame, a receiving space formed by the frame and the conductive front cover;

a diaphragm and a voice coil for driving the diaphragm respectively received in the receiving space, the diaphragm including a conductive dome in the shape of plate and a suspension surrounding the conductive dome, the conductive dome including a plurality of units being isolated from each other, the suspension including two opposite long sides made of non-conductive silica, two opposite short sides made of non-conductive silica and four arc sides made of conductive silica connected with the long sides and the short sides, four conductive pads, one conductive pad located on each arc side and each conductive pad electrically connecting to a corresponding unit of the plurality of units of the conductive dome; wherein the four conductive pads are configured to output electrical signals;

the conductive front cover located above the conductive dome and keeping a distance from the conductive dome;

a plurality of capacitors formed by the plurality of units of the conductive dome and the conductive front cover for outputting electrical signals according to vibrations of the diaphragm and for detecting real-time replacement of the diaphragm.

2. The micro speaker as described in claim 1, wherein an amount of the plurality of units of the conductive dome is 4, and 4 capacitors are accordingly formed by the 4 units of the conductive dome and the conductive front cover.

3. The micro speaker as described in claim 2, wherein the conductive front cover includes a lead wire for outputting electrical signals from the conductive front cover.

4. The micro speaker as described in claim 1, wherein the conductive dome is an aluminum foil dome or a compound aluminum foil.

* * * * *